US011017969B1

(12) United States Patent
Hellmers et al.

(10) Patent No.: US 11,017,969 B1
(45) Date of Patent: May 25, 2021

(54) SELF-DEACTIVATING TETHERED INTERCONNECTION SYSTEM FOR POWER OUTLET

(71) Applicant: ESL POWER SYSTEMS, INC., Corona, CA (US)

(72) Inventors: David Hellmers, Carlsbad, CA (US); Thomas Zinchuk, Temecula, CA (US); Romica Popa, Chino, CA (US)

(73) Assignee: ESL Power Systems, Inc., Corona, CA (US)

( * ) Notice: Subject to any disclaimer, the term of this patent is extended or adjusted under 35 U.S.C. 154(b) by 0 days.

(21) Appl. No.: 16/669,790

(22) Filed: Oct. 31, 2019

(51) Int. Cl.

| | |
|---|---|
| ***H01H 71/08*** | (2006.01) |
| ***H01R 13/648*** | (2006.01) |
| ***H01B 9/00*** | (2006.01) |
| ***H01B 7/04*** | (2006.01) |

(52) U.S. Cl.
CPC ..... *H01H 71/08* (2013.01); *H01B 7/04* (2013.01); *H01B 9/00* (2013.01); *H01R 13/648* (2013.01)

(58) Field of Classification Search
CPC ..... H01B 7/04; H01B 9/00; H01R 13/6683
See application file for complete search history.

(56) References Cited

U.S. PATENT DOCUMENTS

| | | | |
|---|---|---|---|
| 3,238,492 A | | 3/1966 | Houston |
| 3,699,285 A | | 10/1972 | Leatherman |
| 3,733,538 A | | 5/1973 | Kernick et al. |
| 3,846,598 A | | 11/1974 | Mucsi |
| 4,148,536 A | | 4/1979 | Petropoulsos et al. |
| 4,156,885 A | | 5/1979 | Baker et al. |
| 4,271,337 A | | 6/1981 | Barkas |
| 4,346,419 A | | 8/1982 | Janniello |
| 4,628,392 A | * | 12/1986 | Didier ..... E21B 33/0407 200/51.04 |
| 4,849,656 A | | 7/1989 | Neidorff |
| 4,853,823 A | | 8/1989 | Arechavaleta et al. |
| 5,485,340 A | | 1/1996 | Avitan |
| 7,575,467 B2 | | 8/2009 | Ferguson et al. |
| 7,768,247 B2 | | 8/2010 | Sasaki et al. |
| 8,587,914 B2 | | 11/2013 | Kamor et al. |
| 9,742,187 B2 | | 8/2017 | Solomon |
| 9,871,372 B2 | | 1/2018 | Baldridge |
| 10,038,283 B2 | | 7/2018 | Oddsen |

(Continued)

*Primary Examiner* — Mukundbhai G Patel
(74) *Attorney, Agent, or Firm* — Rosenberg, Klein & Lee

(57) ABSTRACT

A self-deactivating tethered interconnection system for a power outlet is provided, in which a circuit breaker actuates to selectively disable transfer of electrical power supplied at a source side of the power outlet to a load side thereof. A conductive tether disposed at the load side transmits the electrical power transferred by the circuit breaker. A power connector coupled to the conductive tether is configured for interconnection with a load for delivery thereto of the electrical power transmitted by the conductive tether. A proving circuit coupled to the power connector and circuit breaker includes a sensing portion that detects an interconnection state of the power connector to the load, and a trip portion operating responsive to the sensing portion to selectively inhibit transfer of the supplied electrical power to the load side. The power connector and conductive tether are thus adaptively de-energized when interconnection with the load is interrupted.

20 Claims, 10 Drawing Sheets

(56) References Cited

U.S. PATENT DOCUMENTS

2013/0069589 A1* 3/2013 Kai ..... H02J 7/0027
320/109
2016/0082853 A1* 3/2016 Kim ..... B60L 53/16
439/620.21

* cited by examiner

SELF-DEACTIVATING TETHERED INTERCONNECTION SYSTEM FOR POWER OUTLET

BACKGROUND OF THE INVENTION

The subject system is generally directed to a system for interconnecting a load to a power outlet for the supply of electrical power thereto. The system provides a tethered interconnection of the load to the power outlet, with safe self-deactivation of the entire tethered interconnection from the electrical power supplied at the power outlet.

A problem often encountered in the shipping, hauling, delivery, and other fields involving mobile equipment which require electrical power is the safe yet reliable provision of off board supply power to energize mobile equipment temporarily interconnected thereto. In certain applications, for example, one or more power outlet fixtures are maintained at a site to provide off board source of power, such as so-called utility power or shore power outlets, to electrify equipment. This may be to power, for instance, refrigerated trailer units or other such electrified cargo container equipment while disposed at a loading/unloading dock, railway yard, shipping port, distribution center, warehouse, truck stop, or anyplace else where they may temporarily dwell.

Mobile equipment of this type are often carried by or integrated into vehicles for transport, and energized during transport by the vehicle's onboard power generation and storage system. Onboard systems typically require the vehicle's power plant (such as an internal combustion engine or battery driven motor) to be running in order to maintain a steady supply of power, even when the vehicle is not in transit. This not only comes at the cost of greater fuel consumption, but in the case of vehicles with internal combustion engines, greater release of noxious fumes. So there is need for ample supply of power apart from the vehicle as an alternate source for electrifying such equipment. The need is magnified with the prevalence of intermodal transport, where modular trailers/containers carrying perishable goods or other payload requiring electrically controlled environments must remain electrified even during the considerable periods of transfer from one transit vehicle to another.

By way of example, in applications where a refrigerated trailer unit (RTU) carried on a truck is to dwell for an extended period at one site, the truck is typically shut down and the RTU interconnected to an off board power outlet fixture provided nearby. Where the site is a conventional loading/unloading dock, an off board power outlet fixture is provided at or about the particular docking bay where the truck is docked. The interconnection is typically made via a connector flexibly tethered to the power outlet fixture by a cable. The connector is configured to plug into a power inlet provided on/for the truck-borne RTU, at which point the RTU is electrified for operation by off board utility supply power.

A recurring mishap in such applications is that of the truck operator failing to properly replace the connector onto a power outlet fixture after unplugging, or even failing to unplug and fully detach the connector before driving off Often, violent destructive detachment occurs as a result of such drive away incident, with the interconnection at least partially torn apart to leave live powered wiring dangerously exposed to the elements on the ground. If the resulting detachment were not actually destructive and the unplugged connector and cable remain intact, they may yet be left unsecured and loose on the ground to extend unrestrained from the power outlet fixture, though still live with supplied power and precariously exposed to the elements. This makes for a serious, highly volatile hazard, especially in the event of rain or puddled water/liquid in the immediate vicinity.

Even where the connector at the plug end were itself equipped with safety measures for deactivation when unplugged, the cable tying the connector to the power outlet—or a remnant thereof—remains live, its wires still supplied with power in the aftermath of a drive away incident. The hazards would persist with this live yet loose cable, particularly as it lies out in the open, unsecured and unsheltered against harmful encounters with passing traffic.

There is therefore a need for suitable measures to safeguard off board power outlet systems in the event of inadvertent detachment of an electrical load therefrom. There is a need to abate the hazards resulting, for example, from drive away incidents or the like where a connector and cable of an off board power outlet system—or any remnant of such connector and cable—are left posing a danger of destructive, even explosive short circuiting and electrical shock to passersby. There is a need to safely de-energize the entire power transferring assembly leading from a given power outlet fixture to a load, including the connector and the cable tethering it to the power outlet fixture, when the connector is disconnected from the load. For added safety, there is also a need to guard the off board power outlet system against destruction in the event of forcible disconnection of the load therefrom.

SUMMARY OF THE INVENTION

An object of the present invention is to provide a system which safeguards off board power outlet systems in the event of inadvertent detachment of an electrical load therefrom.

It is another object of the present invention to provide a system for abating the hazards where a connector and cable of an off board power outlet system are left inadvertently disconnected from a load and left unsecured and exposed to the elements.

It is yet another object of the present invention to provide a system for safely de-energizing the power transferring assembly leading from a given power outlet fixture to a load, when disconnected from the load.

It is still another object of the present invention to provide a system which when disconnected from a load self-deactivates, such that both a connector disconnected from the load and a cable flexibly tethering the connector to a power outlet fixture are de-energized though they remain attached to the power outlet fixture.

These and other objects are attained in a self-deactivating tethered interconnection system for a power outlet, formed in accordance with an exemplary embodiment of the present invention. The system includes a circuit breaker actuating responsive to at least one triggering condition to selectively disable transfer of electrical power supplied at a source side of the power outlet to a load side thereof. A conductive tether is disposed at the load side of the power outlet, which conductive tether defines a proximate end, a distal end, and an intermediate portion extending conductively therebetween. The proximate end is coupled to the circuit breaker, and the intermediate portion transmits from the proximate end to the distal end the electrical power transferred by the circuit breaker. A power connector is coupled to the distal end of the conductive tether. This power connector is configured for interconnection with a load for delivery thereto of the electrical power transmitted by the conductive tether. A proving circuit is coupled to the power connector and circuit breaker, such proving circuit including a sensing portion that detects an interconnection state of the power connector relative to the load. The proving circuit also includes a trip portion operating responsive to the sensing portion to selectively inhibit transfer of the supplied electrical power to the load side. The power connector and conductive tether are thus adaptively de-energized when interconnection with the load is interrupted.

A power outlet system formed in accordance with certain embodiments provides for self-deactivating tethered interconnection to a power inlet of a load. The system includes a power outlet fixture coupled to a source of electrical power and a circuit breaker secured to the power outlet fixture. The circuit breaker actuates responsive to at least one triggering condition to selectively disable transfer of electrical power supplied at a source side thereof to a load side thereof. An interconnection assembly is coupled at the load side of the circuit breaker, and includes a conductive tether having a proximate end, a distal end, and an intermediate portion extending flexibly and conductively therebetween. The proximate end is coupled to the circuit breaker, and the intermediate portion transmits from the proximate end to the distal end the electrical power transferred by the circuit breaker. The interconnection assembly also includes a power connector coupled to the distal end of the conductive tether, where the power connector is configured for mated engagement of the power inlet for delivery to the load of the electrical power transmitted by the conductive tether. A proving circuit is coupled to the interconnection assembly and circuit breaker. The proving circuit includes a trip portion coupled to the circuit breaker, such trip portion adaptively actuating the circuit breaker to disable transfer of the supplied electrical power to the load side according to an interconnection state of said power connector relative to the load. The interconnection assembly is thereby adaptively de-energized when the power connector is disengaged from the power inlet of the load.

A power outlet system formed in accordance with certain other embodiments provides for adaptive breakaway protection for detachable intercoupling to a power inlet of a mobile load. The system includes a circuit breaker disposed at a stationary power outlet receiving electric power supplied by a source. The circuit breaker actuates responsive to at least one triggering condition to selectively disable transfer of supplied electrical power from a source side to a load side thereof. A conductive tether is disposed at the load side of the circuit breaker, the conductive tether having a proximate end, a distal end, and an intermediate portion extending conductively therebetween. The proximate end is coupled to the circuit breaker, and the intermediate portion transmits from the proximate end to the distal end the electrical power transferred by the circuit breaker. A power connector is coupled to the distal end of the conductive tether, and is configured for mated engagement with the power inlet for delivery to the load of the electrical power transmitted by the conductive tether. A proving circuit is coupled to the power connector and circuit breaker. Such proving circuit includes a sensing portion detecting an interconnection state of the mated engagement with the power inlet of the load, and a trip portion adaptively actuating the circuit breaker to disable transfer of the supplied electrical power to the load side according to the interconnection state. A breakaway device is incorporated with at least one of the power connector and conductive tether. The breakaway device is configured for nondestructive separation therethrough upon forcible disconnection of the load from the power outlet. The power connector and conductive tether are thereby adaptively de-energized when disengaged from the power inlet of the load.

DETAILED DESCRIPTION OF THE PREFERRED EMBODIMENTS

Figure 1:
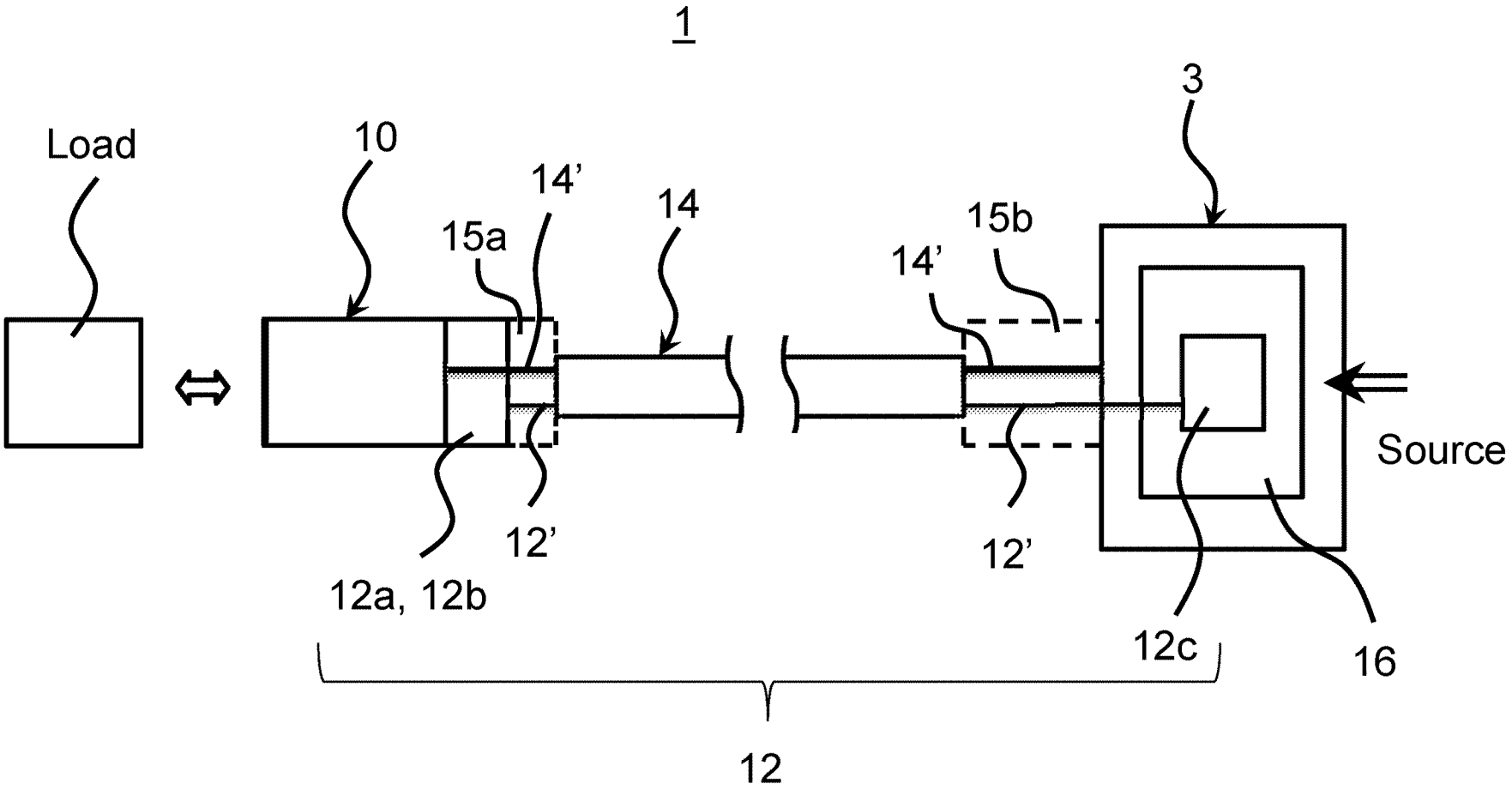
FIG. 1 is a block diagram schematically illustrating the functional interconnection of certain parts of a system formed in accordance with one exemplary embodiment of the present invention.

Reference will now be made in detail to exemplary embodiments, which are illustrated in the accompanying drawings, wherein like reference numerals refer to the like elements throughout. Illustrative embodiments are described herein in order to explain the disclosed system with reference to the figures shown in the drawings for certain exemplary embodiments adapted for certain sample applications.

The subject system is generally directed to a system for interconnecting a load to a power outlet in flexibly tethered manner More specifically, the subject system is directed to the safe supply of electrical power from a power outlet fixture to a load, in which the tethered interconnection leading from the power outlet fixture out to the load is self-deactivated unless it is suitably well interconnected to the load. The system thereby guards against the precarious situation where a 'live,' or energized, supply line appendage of the power outlet fixture is left unsecured and/or dangerously exposed away from the fixture.

Referring to FIG. 1, a system 1 formed in accordance with one exemplary embodiment of the present invention is generally illustrated in block diagram form, integrated with a power outlet 3 of any suitable type in the art. For example, in certain applications, the power outlet 3 may form a stationary fixture that provides an off board source of power for temporary hook up of various loads, such as an RTU or other electrified equipment carried on or integrated into a mobile vehicle.

As shown, system 1 generally includes an interconnection assembly formed in the illustrated embodiment by a power connector 10 and a flexible cable 14 which serves to conductively tether the power connector 10 to the power outlet fixture 3. A proximate end of the cable 14 is coupled to the power outlet fixture 3, while a distal end of that cable 14 is coupled to the power connector 10. Each of the power connector 10 and cable 14 may be of any suitable type known in the art appropriate for the particularly intended application. The number, gauge, configuration, and other specific features of the conductive wires making up the cable 14, for instance, may be determined according to applicable standards for the given embodiment and application. Likewise, the particular configurational make-up of the power connector 10 may be determined according to applicable standards for the given embodiment and application.

Typically, for off board supply power type applications, the power connecter 10 is configured for mated engagement with a load connector of complementary configuration. For example, the power connector 10 is formed with a plurality of sleeve or socket members which serve as terminals for respective wires of the cable 14. Since the power connector 10 is delivering the electrical power, its conductive mating terminals are preferably sheltered as much as reasonably possible within an insulated outer body/housing, with the load connector providing the plugs or other conductive mating terminals that are more exposed outside its insulated body/housing (since it is receiving the electrical power). The individual socket members coaxially receive corresponding plugs which protrude from the load's connector when the power connector 10 is properly 'plugged in' and thereby mated to that load connector.

System 1 also includes a circuit breaker 16 incorporated in the power outlet fixture 3. As used herein, a circuit breaker refers to and encompasses any suitable device or electrical circuit portion known in the art for breaking, interrupting, switching, decoupling, or otherwise inhibiting the transfer of electrical power supplied to the power outlet (from a public or private utility provider or other source) at a source side on to a load side of the power outlet. Circuit breaker 16 preferably operates to permit the normal transfer of supplied electrical power in the absence of certain aberrant conditions such as excessive current, ground fault, or the like. When these aberrant conditions arise, they are taken as triggering conditions which the circuit breaker 16 immediately responds to by suitably disabling the transfer of electrical power, in order to prevent catastrophic mishaps.

Conventionally, the simple disconnection of a load which had been interconnected with a given power outlet fixture does not constitute such a triggering condition. That is so, even when the point of connection/disconnection is not physically housed within the relatively secure immediate confines of the power outlet fixture itself, and tethered out by an interconnection assembly to reach connection points located at or near the load. Unless other triggering conditions incidentally arise, a loose interconnection assembly disconnected from the load would therefore remain energized via the power outlet fixture, as noted herein.

In accordance with certain aspects of the present invention, the interconnection assembly is served by a proving circuit 12 operably coupled to both the power connector 10 and circuit breaker 16, which operates to trip the circuit breaker into disabling the transfer of supplied electrical power to the load side of the power outlet much as it would upon the occurrence of a triggering condition. In effect, the proving circuit 12 establishes or asserts a triggering condition upon the circuit breaker 16, thereby treating disconnection of the interconnection assembly from a load as an aberrant condition requiring power to be duly cut off at the load side of the power outlet in response. The entire interconnection assembly—preferably including at least the power connector 10 and cable/conductive tether 14—is then turned off, or de-energized. Many of the various electrical hazards otherwise posed by a loose, unsecured, or incomplete interconnection assembly are accordingly abated.

In the embodiment shown, the proving circuit 12 preferably includes a sensing portion 12*a* coupled to the power connector 10. Sensing portion 12*a* operates to detect a state of engagement between the power connector 10 and the given load connector. Depending on the embodiment and particularly intended application, the sensing portion 12*a* may suitably employ various types of sensing measures known in the art. In one example such as described in following paragraphs, the sensing portion 12*a* may employ a physically displaceable or deflective element disposed at one or more of the power connector's sockets. When a plug terminal of the load connector then inserts sufficiently into such socket of the power connector 10, the sensing portion 12*a* is caused to displace or deflect enough to indicate successful intercoupling.

The proving circuit 12 includes as well a trip portion 12*c* which operates in response to the sensing portion 12*a* to selectively inhibit the transfer of electrical power to the load side of the power outlet fixture 3. Trip portion 12*c* may employ any suitable measures known in the art to so inhibit power transfer to the interconnection assembly in the absence of proper connection to the load. In the embodiment illustrated in FIG. 1, trip portion 12*c* is suitably coupled to the circuit breaker 16, and operates in response to the sensing portion 12*a* to selectively trip the circuit breaker 16—that is, to responsively establish a triggering condition on the circuit breaker 16—so that it immediately disables supplied electrical power transfer to the load side of the power outlet.

When proper engagement between the power connector 10 and the load connector is detected by the sensing portion 12*a*, the trip portion 12*c* refrains from so tripping the circuit breaker 16. But when the power connector 10 is not properly engaged with the load connector, according to the sensing portion 12*a*, the trip portion 12*c* does trip the circuit breaker 16. A manual override or other condition-specific override measures may be employed in certain embodiments and applications to keep the circuit breaker 16 from indiscriminately tripping when the power connector 10 is disconnected from the load connector, as there may be situations where the disconnection is sufficiently controlled and intentional to permit the interconnection assembly to remain energized.

In accordance with certain aspects of the present invention, system 1 provides for such safety de-activation, adaptive de-energizing measures without requiring any special configured cooperative measures to be implemented in a given load or its power connector. A load may be interconnected with system 1 much as it would with any other power outlet interconnection system conventionally employed in the art for the given application without having to be equipped with a proprietary power inlet device, for instance, to operate fully therewith.

In the illustrated embodiment, the proving circuit 12 preferably also includes a switching portion 12*b* coupled to the sensing portion 12*a*. While shown in this embodiment disposed with the sensing portion 12*a* at the power connector 10, the switching portion 12*b* may be disposed elsewhere in alternate embodiments, such as with the trip portion 12*c* within the power outlet fixture 3. Switching portion 12*b* may be formed by any suitable measures known in the art appropriate for the particularly intended application. In this embodiment, the switching portion 12*b* is formed by an engagement switch device which normally remains open, but closes when the sensing portion 12*a* displaces or deflects a sufficient degree to indicate insert of a load connector plug into a power connector socket by the predetermined distance required for reliable conductive engagement therewith. As described in following paragraphs, closure of the switching portion 12*b* preferably closes a conductive path between the trip portion 12*c* and the circuit breaker 16 in the illustrated embodiment, and opening of the switching portion 12*b* preferably breaks/opens that conductive path.

The supplied electrical power is transmitted through the cable 14 to the power connector 10 by a suitable set of conductive wires which are collectively shown as a primary conductive link 14'. In certain embodiments and applications, the intercoupling of the proving circuit's trip portion 12*c* at the circuit breaker 16 with the sensing portion 12*a* and/or switching portion 12*b* at the power connector 10 may be wirelessly implemented. In the embodiment illustrated, this intercoupling is preferably implemented through a suitable set of wires which are collectively shown as a secondary conductive link 12'. Like the primary conductive link 14', the secondary conductive link 12' extends through the cable 14.

In off board supply power outlet applications such as discussed herein, system 1 may be subject to drive away incidents where a load connector that is properly interconnected to the system is abruptly interrupted and forcibly detached. In addition to the electrical safeguards to adaptively de-activate the interconnection assembly at that instant, system 1 preferably also employs one or more breakaway coupling devices of suitable type known in the art appropriate for the particularly intended application. Examples are shown by the optional breakaway devices 15*a*, 15*b*, disposed for instance at the power connector 10 (device 15*a*) for breakaway coupling to the distal end of the cable 14 and/or at the proximal end of the cable 14 (device 15*b*) for breakaway coupling to the power outlet fixture 3. Each breakaway device 15*a*, 15*b* is of such structure that it undergoes nondestructive separation upon forcible disconnection of the load from the power outlet, to thereby contain any residual damage within itself, and spare the other components from destruction, damage, or compromise.

Figure 1B:
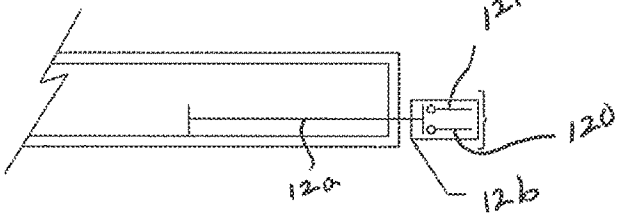
FIG. 1B is an enlarged view, partially cut away, of certain isolated components of the system embodiment illustrated in FIG. 1.
Figure 1A:
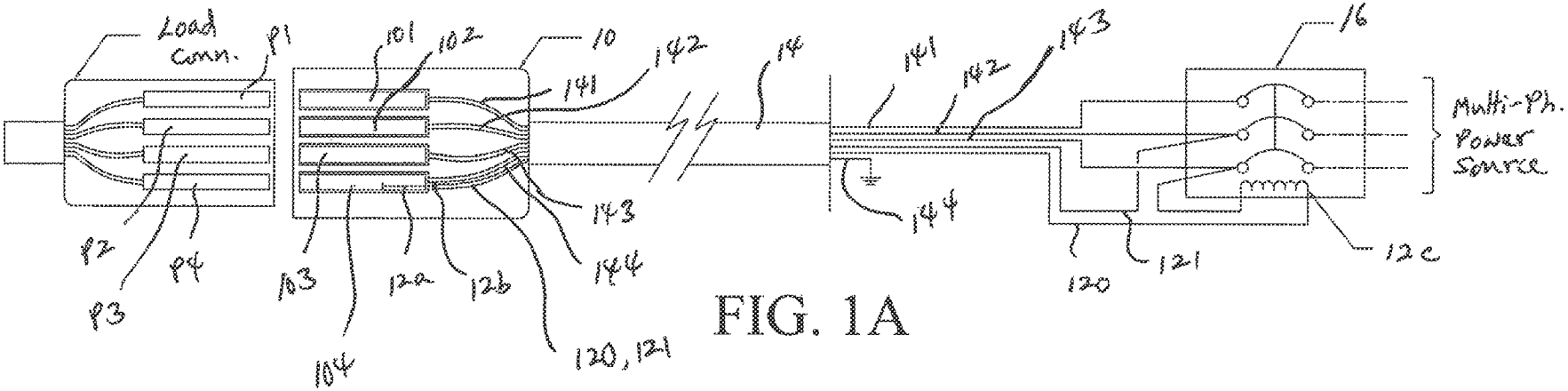
FIG. 1A is a schematic diagram illustrating in greater detail a portion of embodiment illustrated in FIG. 1.
Figure 2A:
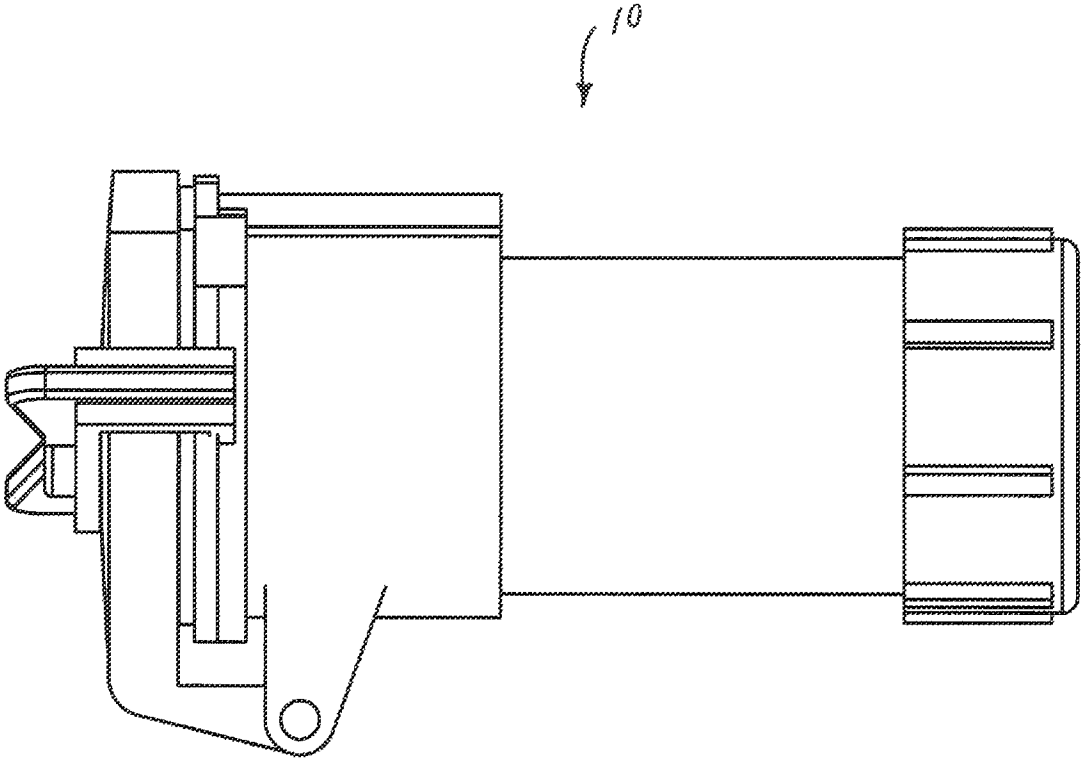
FIG. 2A is an elevational view of an engagement switch equipped power connector employed in an exemplary implementation of the system embodiment illustrated in FIG. 1.
Figure 2B:
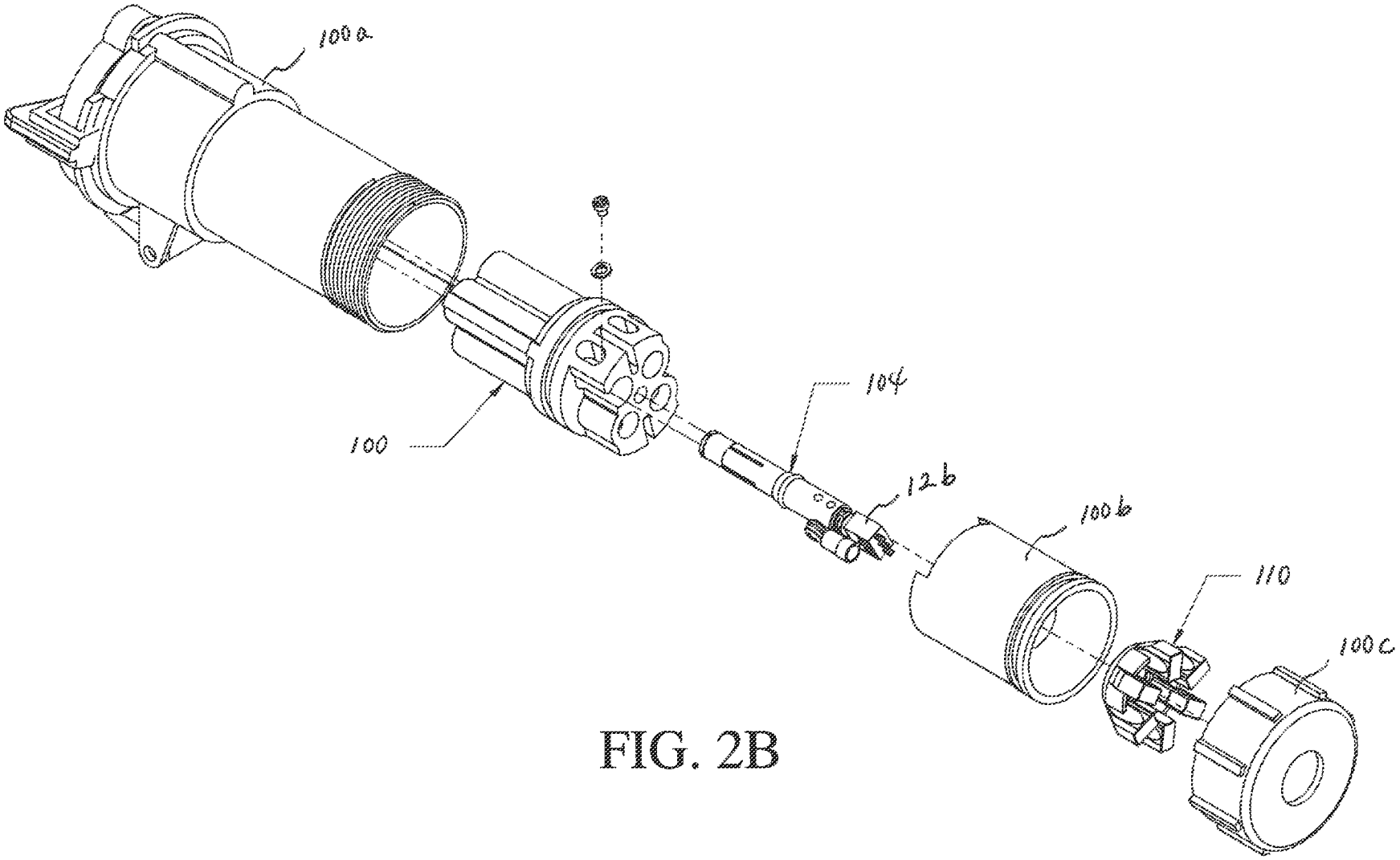
FIG. 2B is an exploded perspective view of the engagement switch equipped power connector shown in FIG. 2A.
Figure 3A:
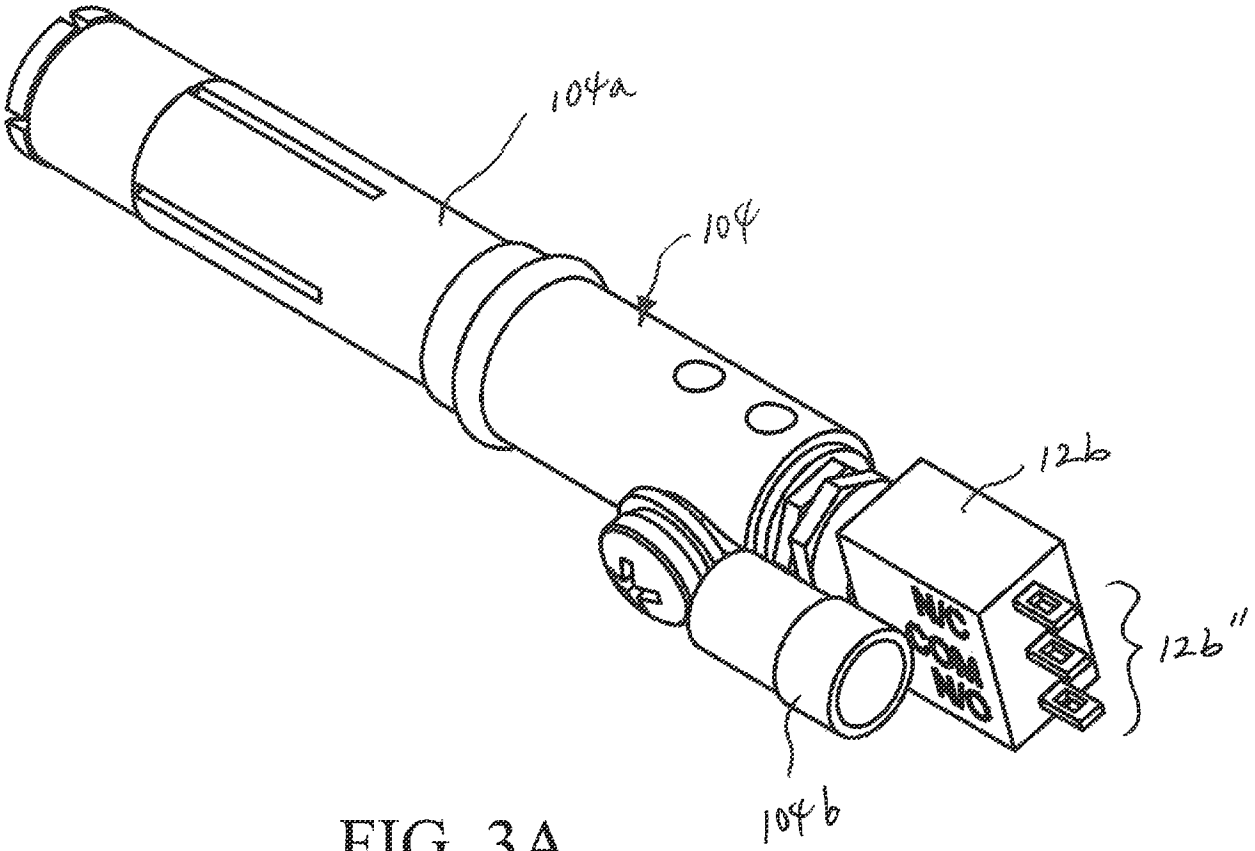
FIG. 3A is an perspective view of certain isolated portions of the power connector shown in FIG. 2A, illustrating an engagement switch incorporated with a ground sleeve member.
Figure 3B:
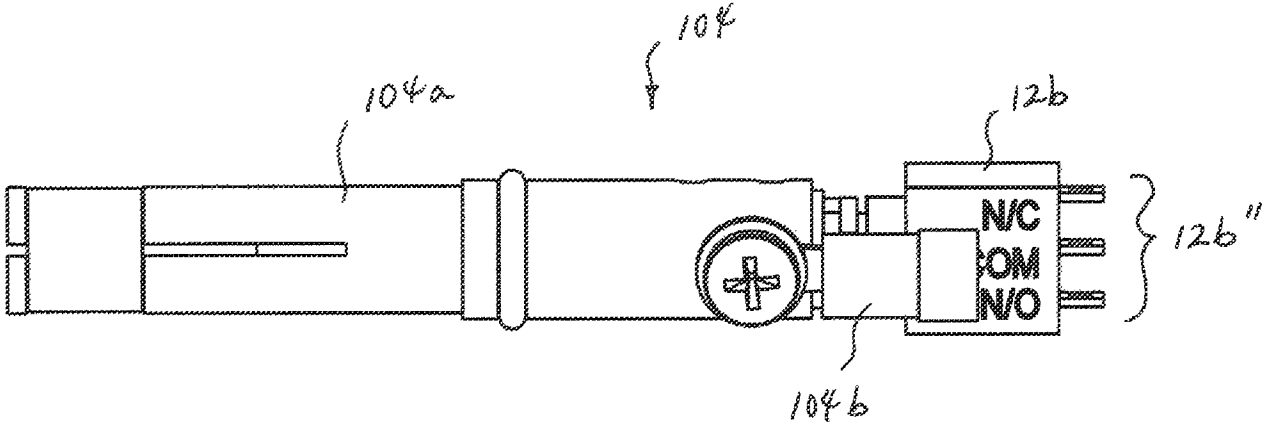
FIG. 3B is a side elevational view of the portions of the power connector shown in FIG. 3A.
Figure 3C:
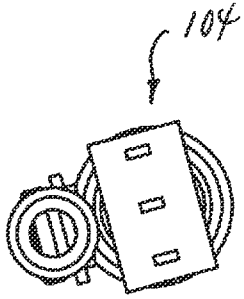
FIG. 3C is rear elevational view of the portions of the power connector shown in FIG. 3A.
Figure 3D:
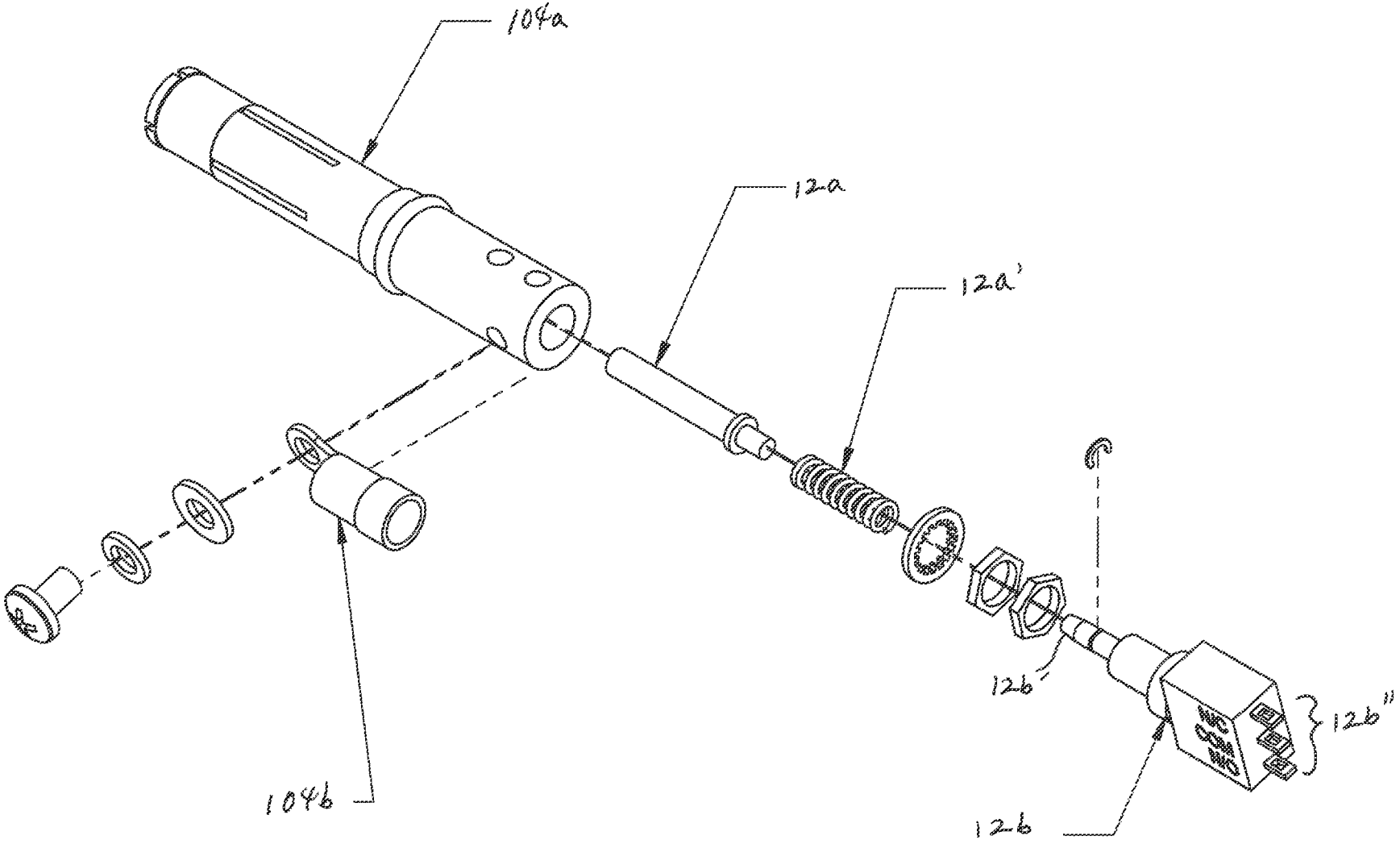
FIG. 3D is an exploded perspective view of the portions of the power connector shown in FIG. 3A.
Figure 4A:
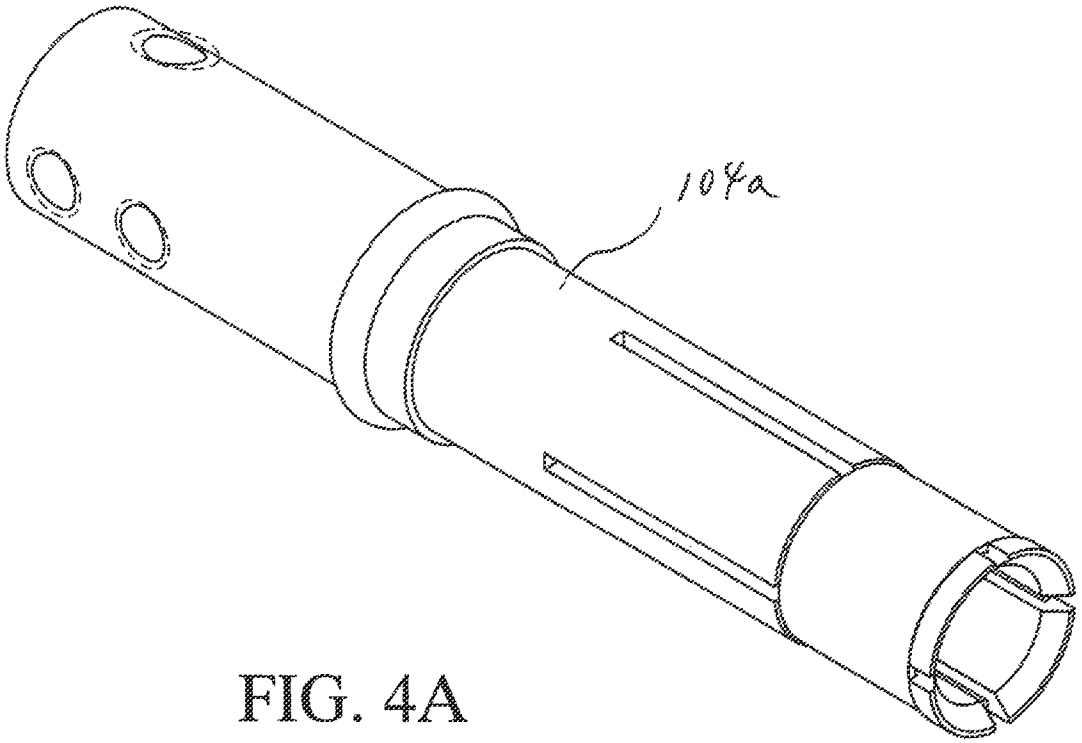
FIG. 4A is an isolated perspective view of the ground sleeve member shown in FIG. 3A.
Figure 4B:
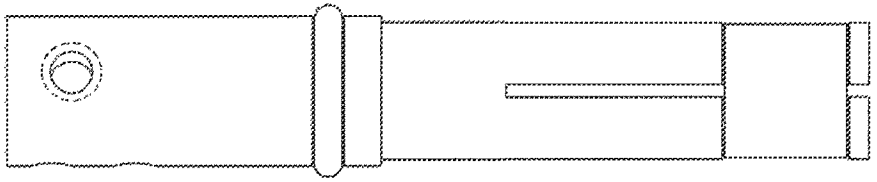
FIGS. 4B-4C are various side elevational view of the ground sleeve member shown in FIG. 4A.
Figure 4C:
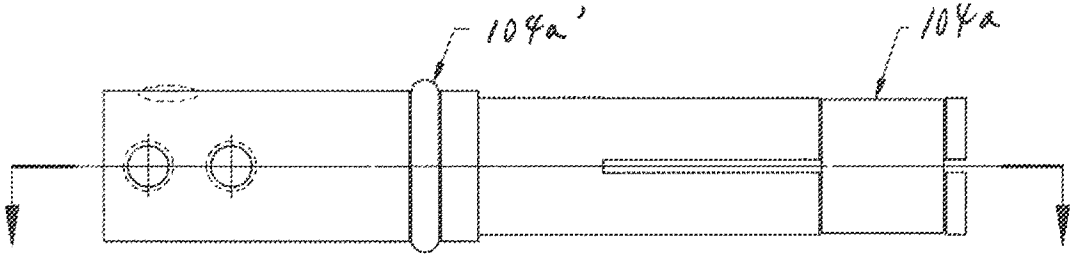
Figure 4D:
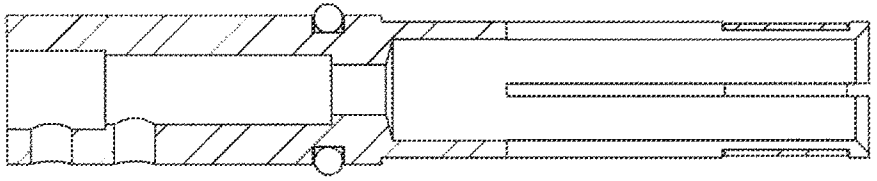
FIG. 4D is a side sectional view of the ground sleeve member shown in FIG. 4A.
Figure 4E:
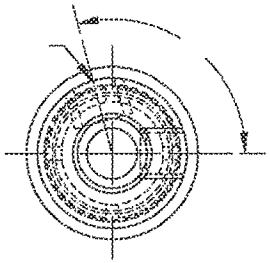
FIG. 4E is a rear elevational view of the ground sleeve member shown in FIG. 4A; and, FIG. 5 is an isolated perspective view of a plunger member shown in the exploded view of FIG. 3D.
Figure 5:
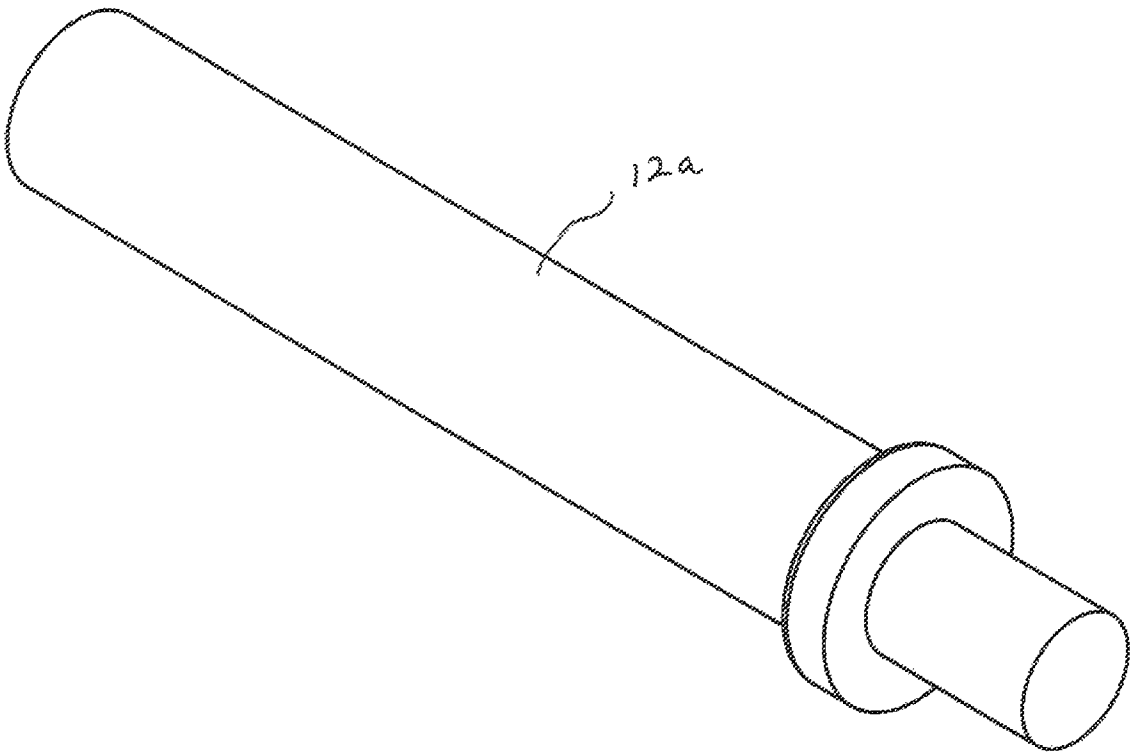

Turning now to FIGS. 1A-1B, certain parts of the system embodiment 1 shown in FIG. 1 are illustrated in greater schematic detail. The electric power supplied by an external source in this application is of polyphase form, such as the 3-phase AC power shown. The circuit breaker 16 transfers this 3-phase power to the load side of the power outlet fixture to respective conductive wires 141, 142, 143 of the cable 14. These conductive wires are carried through the intermediate portion of the cable 14 then out through the distal end thereof to terminate respectively at the conductive sleeve/socket members 101, 102, 103 of the power connector 10. A separate conductive wire 144 that is tied to a system ground reference is carried through the cable 14 to terminate at a conductive ground sleeve/socket member 104 of the power connector 10. The wires 141-144 collectively form the primary conductive link 14' represented in FIG. 1.

The system's proving circuit 12 is implemented in this embodiment by, among other things, the trip portion 12*c* disposed at the circuit breaker 16*a* and the sensing and switching portions 12*a*, 12*b* disposed at the power connector 10. One terminal of the switching portion 12*c* is suitably coupled to the trip portion 12*c* by a conductive wire 120, and the other terminal of switching portion 12*b* is preferably coupled to one of the phases of the supplied 3-phase power (to phase B of the phases A-C) transferred by the circuit breaker 16.

The socket members 101-104 are configured to accept corresponding conductive plug members P1-P4 of the load connector, when the power connector 10 and load connector are mated by 'plugging' together. Each of the plug members P1-P4 coaxially inserts into a corresponding socket member 101-104 for conductively mated engagement therewith. To ensure secure, safe, and effective conductive interface, the plug members P1-P4 must extend at least a predetermined distance into their receiving sockets 101-104 (for instance, more than half its length).

Towards that end, the sensing portion 12*a* of the proving circuit 12 employs in this embodiment a plunger member disposed at the base (inner closed end) of one or more sockets 101-104. For safety and simplicity, a plunger member is preferably disposed within the ground socket 104 as illustrated. FIG. 1B shows an enlarged view of this, where the plunger member 12*a* is configured to displace/deflect when the load connector's ground plug P4 enters the ground socket 104 deeply enough to bear against and displace or deflect the plunger. This in turn actuates the switching portion 12*b*, preferably formed in this embodiment by an engagement switch that connects the conductive wires 120, 121 coupled to its terminals. The conductive wires 120, 121 are carried through the cable 14, and collectively form the secondary conductive link 12' represented in FIG. 1.

The trip portion 12*c* may employ any suitable device known in the art for establishing the necessary triggering condition for the circuit breaker 16, in accordance with the switching state of switching portion 12*b*. The trip portion 12*c* may include, for example, a suitable under voltage release type device incorporated with the circuit breaker 16 to trip the same when a control voltage (such as a portion of the transferred source voltage) normally supplied thereto is removed or dips below a predetermined threshold level. The trip portion 12*c* may also include such other devices as a shunt trip device which trips the circuit breaker 16 when a normally dormant control voltage is applied to the device. In the illustrated embodiment, the under voltage release device is formed by an inductive coil disposed and connected within the proving circuit 12 as shown in FIG. 1A to form a solenoid.

During use the power connector 10, flexibly tethered to the power outlet fixture 3 by the cable 14, is drawn out to reach the load's connector (such as a built in power inlet where the load is an RTU or other such mobile equipment) and securely plugged together with that load connector. The supply power as transferred by the circuit breaker 16 and as transmitted through the cable 14 is then made available through the power connector 10 to the load, and the load is duly powered for operation. At this stage, the load connector's ground plug P4 remains bearing against the plunger 12*a*, keeping the engagement switch 12*b* closed. A conductive path is thereby maintained by the engagement switch 12*b* between the under voltage release device 12*c* and a terminal indicative of a phase of the supplied power as transferred by the circuit breaker 16. This keeps the proving circuit 12 closed, and the circuit breaker's power transfer uninhibited.

While not shown in detail, suitable protective measures known in the art are employed in establishing this conductive path. For example, the conductive path may be established through a step down transformer operating with respect to a given phase of the supplied power, preferably converting the same to a lower voltage version to preserve safer low voltage operating conditions for the particular device(s) employed by trip portion 12*c*.

When the load connector is disconnected from the power connector 10, or at least disturbed enough to interrupt the mated engagement of the ground plug P4 to the ground socket 104, the proving circuit 12 is opened. That is, the plunger 12*a* is released and the engagement switch 12*b* opened, causing the coil of the under voltage release device to deactivate, and driving the circuit breaker 16 to trip in response. Power transfer to the load side of the power outlet is thus inhibited, and the entire interconnection assembly, including the power connector 10 and cable 14, are de-energized—though they may remain physically attached to the power outlet fixture 3. So if the load's ground plug P4 is not intact (it is defective, damaged, or altogether missing), the proving circuit 12 operates to cut the entire tethered delivery channel off from the power outlet fixture to keep the live source of electrical energy well away from the plug P4 and safely contained within the power outlet fixture itself.

Conversely, when the load is to be connected to access off board supply power, the circuit breaker 16 must not be inhibited by the proving circuit 12. So when a user wishes to hook up an RTU or other load for operation, he/she must properly plug and interlock the power connector 10 with the load connector. If so, the proving circuit is closed and the circuit breaker 16 may be reset to resume its transfer of supplied electrical power to the load side of the power outlet. If not, the proving circuit 12 continues to inhibit the circuit breaker's transfer of power to the load side.

Referring to FIGS. 2A-5, there are shown various views of a power connector 10 equipped with certain portions of the proving circuit 12 in one sample implementation of the embodiment 1 schematically illustrated in FIGS. 1-1B. The sample implementation is particularly well suited, for example, for use with trucks in commercial shipping & delivery applications. The truck-borne RTUs in such applications are each typically outfitted with a 3-pole 4-wire (3 phase wires and 1 ground) pin & sleeve male inlet in accordance with applicable standards, such as the International Electrotechnical Commission (IEC) standards IEC 60309-1 and IEC 60309-2. The power connector 10 which mates with this power inlet preferably forms a safety-interlock assembly as shown which incorporates an engagement switch in its connector ground sleeve to sense proper connection to the truck's inlet (such as a corresponding interconnection plug).

In this implementation, the power connector 10 includes a generally cylindrical housing formed of a metallic or other material of suitable strength and rigidity to protectively enclose the interconnection sleeves and proving circuit portions contained therein. The housing is preferably formed by base and collar sections 100*a*, 100*b* between which an insert body 100 is retained, and a cap section 100*c* which retentively engages and closes off an open aft end of the base section 100*a*. A forward end of the base section 100*a* is equipped with a hinged closure, which may be opened and drawn away to make way for interconnection of a power inlet or other connector of the given load equipment.

The cap section 100*c* is preferably formed with an opening to admit the wires from the cable 10 therethrough for coupling to the socket units 104 and proving circuit portions 12*a*, 12*b* held by the insert body 100. Preferably, the cap section 100*c* resiliently biased by a grommet 110 that it captures against the collar section 100*b* for tightly fit coupling to the base section 100*a*. The grommet also aids in sealing against peripheral intrusion of dust, debris, and possibly even liquid about the bunched primary and secondary wires 141-144, 120, 121 admitted through the cap section 100*c*.

A plurality of socket units 101-104 are disposed within respective tubular cavities defined by the insert body 100, although only the grounding socket unit 104 is shown for clarity of illustration. Each of the socket units 101-104 is connected to one of the primary wires 141-144. The ground socket unit 104 is connected to the primary wire 144 tied to a system ground plane. As shown more clearly in the enlarged views of FIGS. 3A-3D, the ground socket unit 104 is includes a sleeve member 104*a* formed of an electrically conductive material which defines a receiving bore extending axially therethrough. An O-ring formed of rubber or other such resilient material is preferably seated about an intermediate part of the sleeve member 104*a* to ensure a secure, frictionally engaged fit within a cavity of the insert body 100. Additionally, a ring lug 104*b* is secured to an outer surface of the sleeve member 104*a*, which receives, crimps, or otherwise fastens to the grounding primary wire 144 (not shown in these views).

The ground socket unit 104 is equipped with the engagement switch 12*b* of the proving circuit 12, preferably in the form of a microswitch, secured to an aft end of the sleeve member 104*a*. The microswitch 12*b* is configured with an actuator 12*b*' projecting from one end into the bore of the sleeve member 104*a* and a plurality of terminals 12*b*" projecting from another end for connection to the secondary wires 120, 121 of the cable 14.

The ground socket unit 104 is also equipped with the plunger member of the sensing portion 12*a* displaceably disposed therein, within the bore of its sleeve member 104*a*. In this embodiment, the plunger 12*a* is spring-loaded by a spring 12*a*' coaxially captured between the plunger 12*a* and the tip of the actuator 12*b*'. When a ground plug member (not shown) of the load's connector/power inlet is properly and sufficiently inserted a predetermined distance into the sleeve member 104*a*, the plug member is grounded by its conductive contact with the surrounding wall of the sleeve member 104*a*, which in turn is tied to system ground by the ring lug 104*b*. In addition, the plug member's leading tip bears against the plunger 12*a*. With further insert, the plug member presses the plunger 12*a* which compresses the spring 12*a*' and contacts and/or displaces the microswitch actuator 12*b*'. This then closes the connection between appropriate ones of the switch terminals 12*b*" to close the conductive path between the trip portion 12*c* and the circuit breaker 16.

Withdrawing the plug member from the sleeve member 104*a* then releases the plunger 12*a* to reversibly displace according to its spring bias, away from the microswitch actuator 12*b*'. The microswitch actuator 12*b*' is also released thereby to open the connection between the appropriate switch terminals 12*b*" and interrupt the conductive path between the trip portion 12*c* and the circuit breaker 16. In accordance with certain aspects of the present invention, the result of this is to de-energize not only the ground and other socket units of the power connector 10, but all the conductive wires of the cable up to the circuit breaker 16 at the given power outlet fixture.

The various parts, portions, and components of the power connector 10 shown in the exemplary embodiment illustrated may each be formed of any suitable material known in the art sufficient to provide the mechanical and electrical properties required by the particularly intended application. More generally, the various parts, portions, and components of the system 1 shown in the illustrated embodiment may likewise be formed of any suitable material known in the art sufficient to provide the mechanical and electrical properties required by the particularly intended application Although this invention has been described in connection with specific forms and embodiments thereof, it will be appreciated that various modifications other than those discussed above may be resorted to without departing from the spirit or scope of the invention as defined herein. For example, functionally equivalent elements or processes may be substituted for those specifically shown and described, certain features may be used independently of other features, and in certain cases, particular locations of the elements or processes may be reversed or interposed, all without departing from the spirit or scope of the invention as defined herein.

What is claimed is:

1. A self-deactivating tethered interconnection system for a power outlet, comprising:

a circuit breaker actuating responsive to at least one triggering condition to selectively disable transfer of electrical power supplied at a source side of the power outlet to a load side thereof;

a conductive tether disposed at the load side of the power outlet, said conductive tether having a proximate end, a distal end, and an intermediate portion extending conductively therebetween, the proximate end being coupled to said circuit breaker, the intermediate portion including a primary conductive link for transmitting from the proximate end to the distal end the electrical power transferred by said circuit breaker;

a power connector coupled to the distal end of said conductive tether, said power connector configured for interconnection with a load for delivery thereto of the electrical power transmitted by said conductive tether, said power connector defining a plurality of conductive mating terminals for said primary conductive link; and, a proving circuit coupled to said power connector and said circuit breaker, said proving circuit including a sensing portion coupled to one of said conductive mating terminals for said primary conductive link, said sensing portion detecting an interconnection state of said power connector relative to the load, said proving circuit including a trip portion operating responsive to said sensing portion to selectively inhibit transfer of the supplied electrical power to the load side;

wherein said power connector and conductive tether are adaptively de-energized when interconnection with the load is interrupted.

2. The system as recited in claim 1, wherein the intermediate portion of said conductive tether is flexible.

3. The system as recited in claim 1, wherein said power connector forms a free end termination for said conductive tether.

4. The system as recited in claim 3, wherein said sensing portion of said proving circuit is coupled to said power connector and said trip portion of said proving circuit is coupled to said circuit breaker, said sensing and trip portions being connected through said conductive tether.

5. The system as recited in claim 4, wherein:

said conductive mating terminals of said power connector include a plurality of sockets for respectively receiving a plurality of interconnection plugs of the load; and, said sensing portion of said proving circuit is disposed to extend into a least one socket of said power connector for detecting substantially full insert of an interconnection plug of the load into the one socket.

6. The system as recited in claim 5, wherein said sensing portion of said proving circuit includes a plunger member displaceably disposed within the one socket, said plunger member being displaced by an interconnection plug of the load advancing into the one socket beyond a predetermined distance to indicate mated engagement.

7. The system as recited in claim 1, wherein said trip portion of said proving circuit includes an under voltage release device selectively establishing the triggering condition responsive to said sensing portion.

8. The system as recited in claim 7, wherein:

said conductive mating terminals of said power connector include a ground socket for receiving a corresponding interconnection plug of the load; and, said sensing portion of said proving circuit is disposed to extend into said ground socket of said power connector for detecting substantially full insert of the corresponding interconnection plug of the load into the ground socket.

9. The system as recited in claim 1, wherein at least one of said power connector and conductive tether includes a breakaway device configured for nondestructive separation therethrough upon forcible disconnection of the load from the power outlet.

10. A self-deactivating tethered interconnection system for a power outlet, comprising:

a circuit breaker actuating responsive to at least one triggering condition to selectively disable transfer of electrical power supplied at a source side of the power outlet to a load side thereof;

a conductive tether disposed at the load side of the power outlet, said conductive tether having a proximate end, a distal end, and an intermediate portion extending conductively therebetween, the proximate end being coupled to said circuit breaker, the intermediate portion transmitting from the proximate end to the distal end the electrical power transferred by said circuit breaker;

a power connector coupled to the distal end of said conductive tether, said power connector configured for interconnection with a load for delivery thereto of the electrical power transmitted by said conductive tether; and, a proving circuit coupled to said power connector and said circuit breaker, said proving circuit including a sensing portion detecting an interconnection state of said power connector relative to the load, said proving circuit including a trip portion operating responsive to said sensing portion to selectively inhibit transfer of the supplied electrical power to the load side;

wherein said power connector and conductive tether are adaptively de-energized when interconnection with the load is interrupted;

wherein said trip portion of said proving circuit includes an under voltage release device selectively establishing the triggering condition responsive to said sensing portion wherein:

said power connector includes a ground socket for receiving a corresponding interconnection plug of the load;

said sensing portion of said proving circuit is disposed to extend into said ground socket of said power connector for detecting substantially full insert of the corresponding interconnection plug of the load into the ground socket;

said sensing portion includes a plunger member displaceably disposed within said ground socket, said plunger member being displaced between first and second positions by the corresponding interconnection plug of the load advancing into said ground socket beyond a predetermined distance; and, said proving circuit further includes a switching portion, said switching portion being disposed in an open state when said plunger member is disposed in the first position and in a closed state when said plunger member is disposed in the second position, said switching portion in the open and closed states alternatively opening and closing a conductive path between said under voltage release device and said circuit breaker;

whereby said under voltage release device establishes the triggering condition for said circuit breaker when said switching portion is disposed in the open state.

11. A power outlet system having a self-deactivating tethered interconnection to a power inlet of a load, comprising:

a power outlet fixture coupled to a source of electrical power;

a circuit breaker secured to said power outlet fixture, said circuit breaker actuating responsive to at least one triggering condition to selectively disable transfer of electrical power supplied at a source side thereof to a load side thereof;

an interconnection assembly coupled at the load side of said circuit breaker, said interconnection assembly including:

a conductive tether having a proximate end, a distal end, and an intermediate portion extending flexibly and conductively therebetween, the proximate end being coupled to said circuit breaker, the intermediate portion including a primary conductive link for transmitting from the proximate end to the distal end the electrical power transferred by said circuit breaker; and, a power connector coupled to the distal end of said conductive tether, said power connector configured for mated engagement of the power inlet for delivery to the load of the electrical power transmitted by said conductive tether, said power connector defining a plurality of conductive mating terminals for said primary conductive link; and, a proving circuit coupled to said interconnection assembly and said circuit breaker, said proving circuit including a trip portion coupled to said circuit breaker, said trip portion adaptively actuating said circuit breaker to disable transfer of the supplied electrical power to the load side according to an interconnection state of said power connector relative to the load, said proving circuit including a sensing portion coupled to one of said conductive mating terminals for the primary conductive link;

wherein said interconnection assembly is adaptively de-energized when said power connector is disengaged from the power inlet of the load.

12. The system as recited in claim 11, wherein:

said conductive mating terminals of said power connector include a plurality of sockets for respectively receiving a plurality of interconnection plugs of the power inlet; and said sensing portion is coupled to extend into at least one of said sockets of said power connector for detecting a mated engagement of at least one of said sockets by an interconnection plug of the power inlet, the interconnection state of said power connector being determined based on the detection.

13. The system as recited in claim 12, wherein said sensing portion includes a plunger member displaceably disposed within the socket, said plunger member being disposed for displacement responsive to an interconnection plug of the load advancing into the socket beyond a predetermined distance to indicate mated engagement.

14. The system as recited in claim 12, wherein said trip portion includes a shunt trip device coupled to said circuit breaker, said shunt trip device being activated responsive to said sensing portion to establish the triggering condition for driving said circuit breaker to disable transfer of the supplied electrical power to the load side.

15. The system as recited in claim 14, wherein at least one of said power connector and conductive tether includes a breakaway device configured for nondestructive separation therethrough upon forcible disconnection of the load from the power outlet fixture.

16. The system as recited in claim 12, wherein:

said sensing portion extends into a ground socket of said power connector for detecting substantially full insert of the corresponding interconnection plug of the load into the ground socket;

said proving circuit further includes a switching portion set in switching state by said sensing portion; and, said trip portion includes a first terminal electrically coupled for variation with at least a portion of the supplied electrical power and a second terminal electrically coupled to said switching portion.

17. The system as recited in claim 16, wherein said switching portion is set from an open state to a closed state responsive to the corresponding interconnection plug advancing into said ground socket beyond a predetermined distance, said switching portion in the open and closed states alternatively opening and closing a conductive path between said first and second terminals of said trip portion.

18. A power outlet system having adaptive breakaway protection for detachable intercoupling to a power inlet of a mobile load, comprising:

a circuit breaker disposed at a stationary power outlet receiving electric power supplied by a source, said circuit breaker actuating responsive to at least one triggering condition to selectively disable transfer of supplied electrical power from a source side to a load side thereof;

a conductive tether disposed at the load side of said circuit breaker, said conductive tether having a proximate end, a distal end, and an intermediate portion extending conductively therebetween, the proximate end being coupled to said circuit breaker, the intermediate portion including a primary conductive link for transmitting from the proximate end to the distal end the electrical power transferred by said circuit breaker;

a power connector coupled to the distal end of said conductive tether, said power connector configured for mated engagement with the power inlet for delivery to the load of the electrical power transmitted by said conductive tether, said power connector defining a plurality of conductive mating terminals for said primary conductive link; and, a proving circuit coupled to said power connector and said circuit breaker, said proving circuit including:

a sensing portion coupled to one of said conductive mating terminals for said primary conductive link, said sensing portion detecting an interconnection state of the mated engagement with the power inlet of the load; and, a trip portion adaptively actuating said circuit breaker to disable transfer of the supplied electrical power to the load side according to the interconnection state; and, a breakaway device incorporated with at least one of said power connector and conductive tether, said breakaway device configured for nondestructive separation therethrough upon forcible disconnection of the load from the power outlet;

wherein said power connector and conductive tether are adaptively de-energized when disengaged from the power inlet of the load.

19. The system as recited in claim 18, wherein said trip portion of said proving circuit includes an under voltage release device coupled to said circuit breaker, said under voltage release device being activated responsive to said sensing portion to establish the triggering condition for driving said circuit breaker to disable transfer of the supplied electrical power to the load side.

20. The system as recited in claim 19, wherein said proving circuit further includes a switching portion set between open and closed states responsive to the interconnection state of the mated engagement between the power connector and the power inlet of the load, said switching portion in the open and closed states alternatively opening and closing a conductive path between said under voltage release device and said circuit breaker, said under voltage release device establishing the triggering condition for said circuit breaker when the conductive path is open.

* * * * *